United States Patent [19]

Fischer

[11] 4,125,230

[45] Nov. 14, 1978

[54] GOLF BALL RETRIEVAL APPARATUS

[76] Inventor: George J. Fischer, 2178 N. Jerusalem Rd., North Bellmore, N.Y. 11710

[21] Appl. No.: 800,359

[22] Filed: May 25, 1977

[51] Int. Cl.[2] ..... A63B 69/36

[52] U.S. Cl. ..... 242/54 R; 273/184 B; 273/196

[58] Field of Search ..... 242/54 R, 54 A, 84.2 R, 242/84.21 A, 54.1, 82; 273/26 E, 29 R, 58 C, 95 A, 97 R, 196, 198, 200, 184 B; 43/43.11, 25

[56] References Cited

U.S. PATENT DOCUMENTS

| | | | |
|---|---|---|---|
| 2,873,925 | 2/1959 | Huth et al. | 242/54.1 |
| 2,989,259 | 6/1961 | Youhouse et al. | 242/54 A |
| 3,039,715 | 6/1962 | Caperton | 242/82 |
| 3,361,377 | 1/1968 | Trexler, Jr. | 242/54 A |
| 3,629,966 | 12/1971 | Sanchez | 43/25 |
| 3,707,268 | 12/1972 | Kelly | 242/54 R |
| 3,876,162 | 4/1975 | Chun et al. | 242/54 R |

*Primary Examiner*—Leonard D. Christian
*Attorney, Agent, or Firm*—Darby & Darby

[57] ABSTRACT

Golf ball retrieval apparatus characterized by reduced drag on the ball after it is driven from the apparatus, is disclosed. The apparatus includes a base, a take-up reel driven by a selectively actuatable reel motor connected to the base and adapted to draw a golf ball, connected by a tether to the reel, toward the base. A reel motor switch is mounted on the base and positioned so as to automatically deactivate the reel motor in response to tension in the tether caused by the arrival of the golf ball at a predetermined location on the base. The apparatus also includes a pair of rotatable tether drive wheels mounted on the base, a shifting mechanism coupled to at least one of the tether drive wheels which responds to the activation of the reel motor switch so as to move the first and second tether drive wheels together a distance sufficient to enable them to frictionally engage the tether, and a selectively actuatable wheel motor mounted on the base which is activated in response to the activation of the reel motor switch for rotating the tether wheels, whereby the tether wheels remove at least a portion of the tether from the take-up reel. The apparatus further includes an elongated tubular member, open at both ends, coupled to the base and a guide located between the tubular member and the tether drive wheels, at least a portion of the guide extending through one of the end openings of the tubular member and being located within the tube. The tubular member receives a selected portion of the tether which is removed from the take-up reel and maintains the tether in a slack condition. A wheel motor switch connected to the tether wheel motor for deactivating the wheel motor and for permitting the tether drive wheels to move away from one another after a pre-selected length of tether is removed from the take-up reel is also provided.

22 Claims, 4 Drawing Figures

GOLF BALL RETRIEVAL APPARATUS

This abstract is not to be taken either as a complete exposition or as a limitation of the present invention; however, the full nature and extent of the invention being discernible only by reference to and from the entire disclosure.

BACKGROUND OF THE INVENTION

This invention relates to tethered golf ball retrievers and more specifically to such retrievers which provide reduced resistance to the ball when it is struck so as to drive it from the retriever.

Golfers, in their attempt to achieve proficiency in the sport, frequently spend substantial amounts of time in practicing the game. Practice areas where a golfer may rent a quantity of practice golf balls have proliferated in an effort to provide satisfactory facilities for such practicing. From the point of view of the golfer, however, such facilities suffer from an obvious disadvantage. This disadvantage is that the facilities are frequently located some distance from the places where the golfer usually lives or works and, therefore, one who wishes to utilize such a facility must spend what may be a substantial amount of time in traveling to and from the practice area. In an effort to overcome this obvious disadvantage, golf ball retrieval devices which may be used as personal practice apparatus have been developed. These devices are frequently small portable units which include a motor and a take-up reel. In operation, a golfer, desiring to practice his golf stroke, strikes a ball, which is connected by a tether to the device, and the motor-driven take-up reel subsequently retrieves the ball to the practice device where it may be positioned for subsequent practice. In operation, however, these devices although much more convenient in utilization than traveling to a practice area, also suffer from a number of disadvantages. For example, the struck ball, at the beginning of its flight from the device, must overcome substantial resistance provided by the inertia of the take-up reel having the tether wound thereon. In addition, lightweight, hollow, perforated balls, commonly known as WHIFFLE balls, cannot be used with such devices because their mass is so low that for all practical purposes they are incapable of drawing the tether from the take-up reel. Finally, such devices have long been recognized as being unsatisfactory in that a substantial amount of energy is utilized in overcoming the inertia of the take-up reel rather than in imparting motion to the golf ball and, therefore, an inaccurate representation of the results of a golf swing is provided to the golfer. In an effort to overcome these substantial disadvantages, a modified form of golf practice device has been proposed. This modified practice device is substantially similar to that discussed above with the exception that the take-up reel is of a construction comparable to that of a reel utilized as a spinning reel in fishing. An example of such a golf practice device is illustrated in U.S. Pat. No. 3,826,439. Although such type of golf ball practice device or retriever represents a substantial improvement over the type using a conventional take-up reel, it has been found that the spinning reel type of device also suffers from a substantial disadvantage. This is due to the fact that these types of take-up reels frequently snarl or kink during the take-up process and these kinks and snarls cause substantial line resistance (drag) when they are withdrawn from the reel. It may therefore be seen that, although the spinning reel type of golf ball retriever does, in substantial respects, overcome the disadvantage of golf practice apparatus which is associated with conventional reel and line drag, the device is subject to other disadvantages.

SUMMARY OF THE INVENTION

It is, therefore, an important object of the present invention to provide a golf ball retrieval apparatus by means of which the aforesaid drawbacks and disadvantages may be most efficaciously avoided.

It is a further object of this invention to provide such a device which presents virtually no line drag resistance to the struck ball.

It is still another object of this invention to provide such a device which does not cause kinks and snarls in the tether attaching the ball to the device during the take-up precedure.

It is yet another object of this invention to provide such a device wherein slack is provided in the tether after the tether is wound onto the take-up reel.

It is a feature of this invention to provide such a device wherein after the tether is wound onto the take-up reel, a portion of the tether is withdrawn from the take-up reel and stored in a slack, coiled, configuration.

It is a still further object of this invention to provide a flexible line storage apparatus whereby said line may be stored in a slack, unknotted, condition.

Generally speaking, the objectives of the present invention are attained by the provision of a retrieval apparatus comprising support means, recovery means connected to the support means, adapted to draw an object, connected by a tether to the recovery means, toward the support means, and slacking means connected to the support means, adapted to provide slack in the tether.

More specifically, the objectives of the present invention are attained by the provision of a retrieval apparatus comprising a base, a take-up reel driven by a selectively actuatable reel motor connected to the base and adapted to draw a ball, connected by a tether to the reel, toward the base, reel motor switching means connected to the reel motor for automatically deactivating the motor in response to the drawing of the ball to a preselected position relative to the base, first and second rotatable tether drive wheels mounted on the base, shifting means coupled to at least one of the tether drive wheels and responsive to the activation of the reel motor switching means for decreasing the distance between the tether drive wheels whereby the wheels frictionally engage the tether, a selectively actuatable wheel motor mounted on the base and activated in response to the activation of the reel motor switching means for rotating the tether wheels, whereby the tether wheels remove at least a portion of the tether from the take-up reel, an elongated tubular member having openings at both ends thereof coupled to the base, guide means located between the tubular member and the tether drive wheels, at least a portion of the guide means extending through one of the tubular end openings and being located within the tubular member, the tubular member receiving at least a portion of the tether removed from the take-up reel and maintaining the tether in a slack condition, and wheel motor switching means coupled to the wheel motor for deactivating the wheel motor in response to the removal of a preselected length of tether from the take-up reel.

The objectives of the present invention are also attained by the provision of a flexible line storage apparatus comprising an elongated hollow receptacle having an opening in at least one end thereof, guide means located proximate to the receptacle adapted to receive a flexible line and guide the line to the interior of the receptacle, and drive means so located as to be adapted to urge the flexible line through the guide means and into the receptacle, whereby the line may be stored in a slack condition.

BRIEF DESCRIPTION OF THE DRAWINGS

The foregoing and other objects and features of the present invention will be more clearly understood from the following detailed description thereof when read in conjunction with the accompanying drawings, in which.

DESCRIPTION OF THE PREFERRED EMBODIMENT

Figures 1, 2, 3:
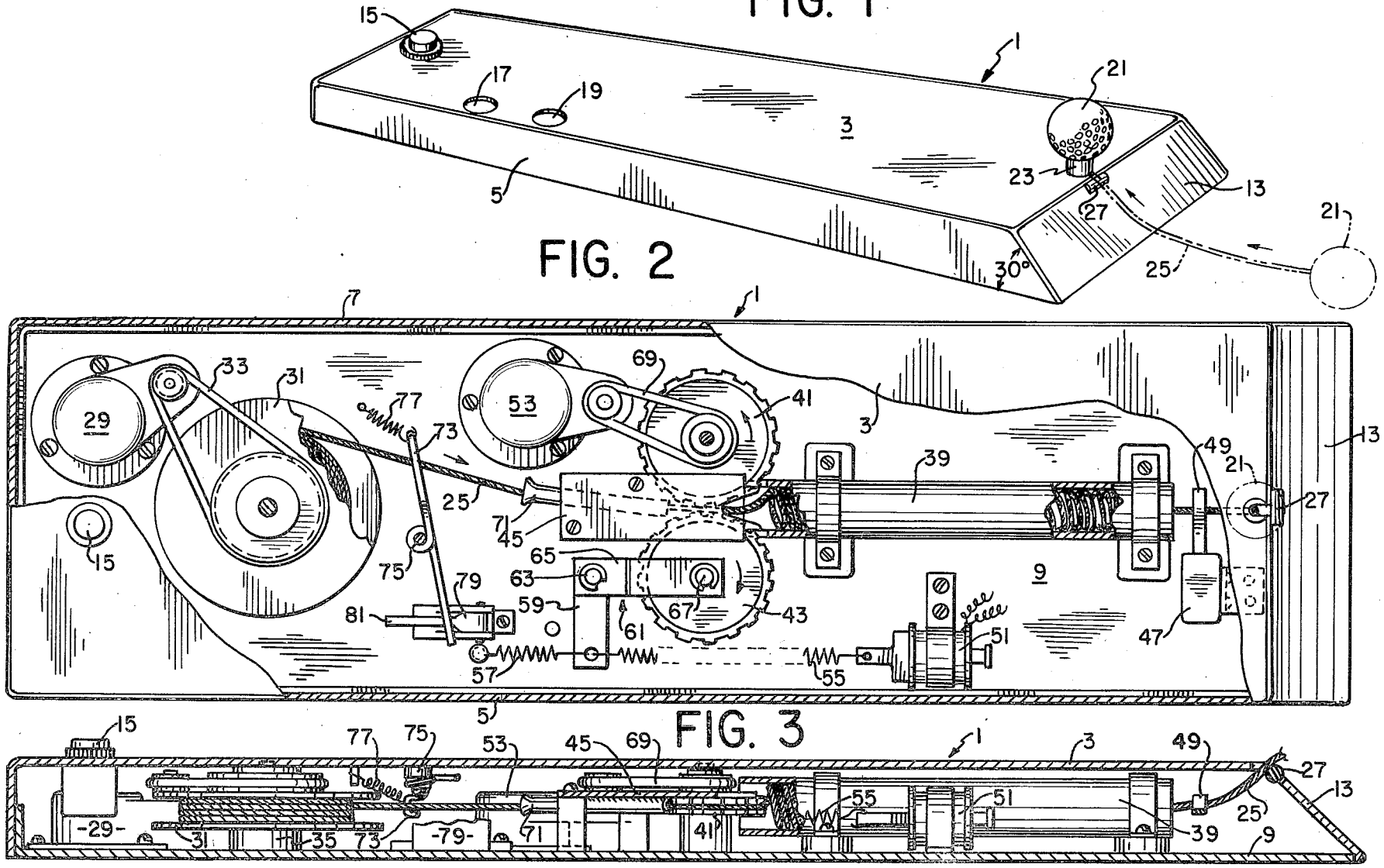
FIG. 1 is a perspective view of the invention.
FIG. 2 is a plan view, with parts broken away, illustrating the invention at one point in its sequence of operation.
FIG. 3 is a side view of the invention, with parts broken away.

Turning first to FIG. 1, there is illustrated a perspective view of the inventive golf ball retrieval apparatus. The apparatus includes an enclosure or support 1 including a top 3, sides 5 and 7, a bottom 9, and ends 11 and 13. Each of the surfaces is orthogonal with respect to each adjacent surface with the exception of the surface 13 which forms the front of the unit 1, the front 13 forming an acute angle with the bottom 9 so as to provide a ramp. For ease of illustration, the angle formed between front 13 and bottom 9 has been illustrated as being approximately 30° , although any other acute angle is suitable. The forward portions of the sides 5 and 7 may also be beveled or rounded in a manner similar to that shown with respect to the surface 13, if that is desirable. Such a configuration may advantageously be utilized if it is believed that balls will frequently return to the apparatus from the sides. A switch activator and switch, both indicated at 15, extend through the top surface 3 of the support enclosure 1 and the enclosure is formed with two apertures or windows 17 and 19, labeled, for example, "ready" and "not ready," respectively, which, as will be explained below, serve as indicator windows to advise the user when the apparatus is ready for use. A golf ball 21 mounted on a tee 23 is illustrated in position for striking with a golf club on the unit 1. The ball 21 is also shown, in phantom lines, spaced from the unit 1, the ball connected to the unit by a tether, 25. It will be understood, of course, that the ball 21 and tee 23 may be constructed as an integral unit in which case both the ball and tee will be driven from the unit 1 by the striking of the ball. The apparatus may also be utilized without a tee and in such event the ball 21 would rest on the upper surface 3 of the unit 1 or, could rest on a thin plate (not shown) attached to the upper surface 3. A golfer may also, of course, utilize the apparatus by manually inserting a tee between the unit 1 and the ball 21 after the ball has been retrieved by the unit and is in place on the upper surface 3. A low friction roller 27, made, for example, of TEFLON, is positioned within a slot formed in the unit 1 permitting the tether to be drawn from the unit after the ball is struck with virtually no surface friction.

Figure 4:
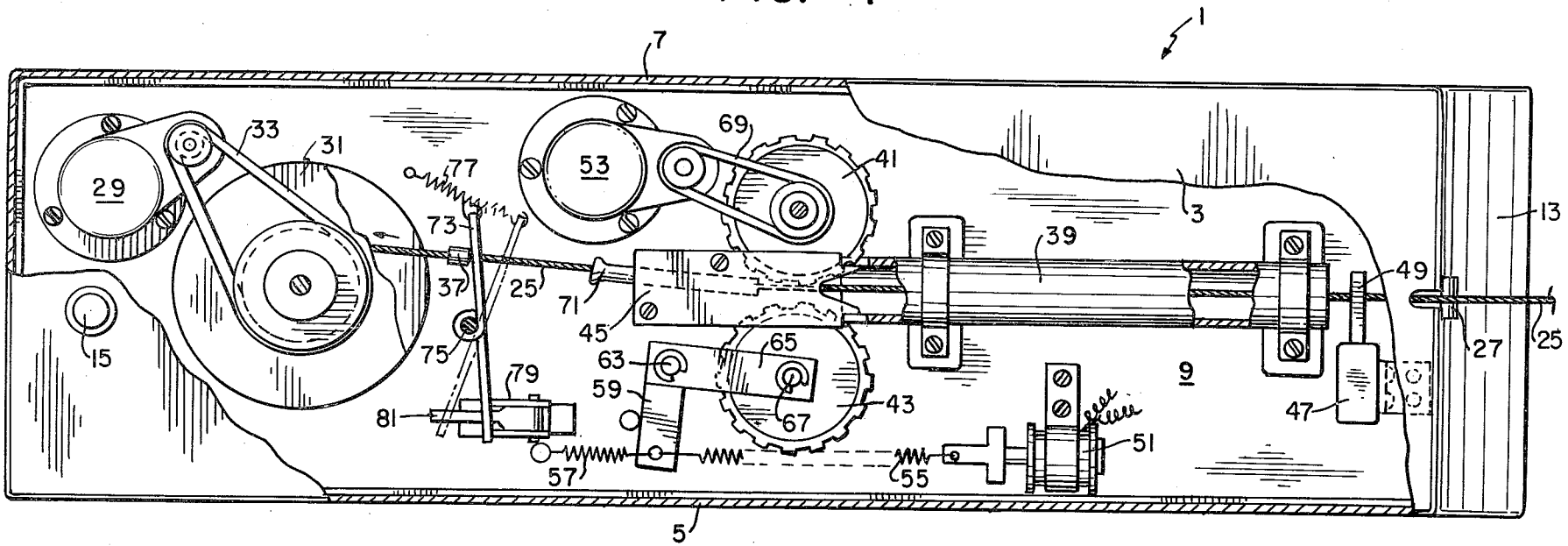
FIG. 4 is a plan view, with parts broken away, illustrating the invention of another point in its sequence of operation.

Referring now to FIGS. 2, 3 and 4, the operation of the device will be explained in detail. Turning first to FIG. 4, the operation of the device in drawing a tethered golf ball to the unit 1 will be described. As illustrated, the ball has been driven from the unit and switch 15 has just been activated. Actuation of the switch 15 activates a reel motor 29 which causes the reel 31 to rotate in a counter-clockwise direction as viewed in FIG. 4 and activates a miniature lamp (not shown) located beneath the window 19 for a purpose to be explained below. In this embodiment, the motor 29 has been illustrated as being coupled to the reel 31 by a drive belt 33, although, of course, gear wheels or other coupling mechanisms could be used as well. As most clearly seen in FIG. 3, the motor 29, which is electrically connected to the switch 15 in any conventional manner, is mounted on the base 9 of the unit and the reel 31 is rotatably mounted on the unit by means of a shaft 35 which extends between the base 9 and the upper surface 3. Rotation of the reel 31 in a counterclockwise direction draws the tether 25 onto the reel and also draws a block 37 onto the reel, the function of the block 37 to be more fully explained below.

The ball 21, which is attached to the tether 25, is drawn toward the unit by the rotation of the reel 31 in a conventional manner, well known in the prior art, until the ball is in the position shown in FIGS. 1 and 2, that is, in place on the unit 1. The tether, prior to its being wound onto the reel 31, passes through an elongated tubular member, indicated at 39, between a pair of spaced tether wheels 41 and 43 and through a guide 45. When the ball is in the position illustrated in FIGS. 1 and 2, the operation of the motor 29 urging the reel 31 to continue rotating draws the tether taut thereby actuating a microswitch 47 having a switching lever 49. Activation of the microswitch 47 deactivates the motor 29, activates a solenoid 51 and energizes a motor 53. This last-noted sequence of events, initiated by the return of the ball to the unit 1 causes the tether 25 to be moved into the tube 39 where it remains, in a loosely coiled slack condition, until the ball is subsequently struck, thereby withdrawing the tether from the tube.

Turning now to FIG. 2, the operation of the apparatus during the tether slacking sequence will be described in detail. As previously indicated, the drawing taut of the tether 25 actuates the microswitch 47 via movement of switch lever 49. The microswitch 47, which is electrically connected in any conventional manner to the solenoid 51, to the reel motor 29 and to the wheel motor 53 serves to deactivate the reel motor 29, actuate the solenoid 51 and actuate the wheel motor 53. The reel motor 29 is deactivated so that the reel 31 may freely rotate in a clockwise direction as viewed in FIG. 2, thereby permitting the tether to be withdrawn from the reel. The solenoid 51 is actuated so as to move the tether wheel 43 into proximity with the tether wheel 41. The solenoid 51 acts through a spring 55 and a spring 57, both of which are connected to one leg 59 of an L-shaped pivot member 61, which member is arranged to pivot about a shaft 63. The tether wheel 43 is rotatably mounted on the other leg, indicated at 65, of the member 61, by means of a shaft 67. In operation, actuation of the solenoid 51 draws the spring 55 to the right as seen in FIG. 2 (against the force provided by the spring 57) thereby causing the member 61 to pivot in a counterclockwise direction as seen in FIG. 2, thus uring the tether wheel 43 into proximity with the tether wheel 41. The two tether wheels, 43 and 41, are toothed and, as illustrated in FIG. 2, are sufficiently proximate after actuation of the solenoid 51 to frictionally engage the tether 25 between them. The actuation of the solenoid 51 has also, as previously indicated, actuated the wheel drive motor 53 thereby causing the rotation, by means, for example, of a drive belt 69, of the tether wheel 41. The action of the toothed tether wheels, driven by the wheel motor 53, draws the tether from the reel 31, pushing the tether into the tube 39.

It has been found that a tether guide of the kind illustrated in FIG. 2 at 45, including an elongated tubular entrance portion indicated at 71, a forward portion having a V-shaped cross-sectional configuration which extends into the interior of the tube 39, in combination with the tube 39, causes the tether 25 to assume a slack, unknotted, loosely coiled, configuration upon entering the tube. It will be understood that the slack, loosely coiled tether will, after it is completely inserted into the tube 39, remain stored within the tube 39 until the ball 21 is subsequently struck, thereby driving the ball away from the device and withdrawing the tether from the tube.

Continuing with the sequence of events, after a preselected quantity of tether is removed from the reel 31, the block 37, attached to the tether for this purpose, contacts a rod 73 pivotally mounted in the unit 1 by means of a pivot shaft 75. The block 37 causes the rod 73 to rotate about the shaft 75 as illustrated in phantom lines in FIG. 4. The rod 73, which is urged in a counterclockwise direction (as viewed in FIG. 2) by a spring 77 is urged, against the force of the spring 77 a distance sufficient to actuate a microswtich 79 having an actuating lever 81. For reasons which will be more fully discussed below, the rod 73 will remain in its clockwise rotated position only momentarily and it is for this reason that the rod is illustrated in phantom lines in FIG. 4. The microswitch 79 is electrically connected, in any conventional manner, to the solenoid 51, to the wheel motor 53 and to a miniature lamp (not shown) located under the window 17. Actuation of the microswitch 79 deactivates both the wheel motor 53 and the solenoid 51 as well as actuating the lamp under aperture 17, the activation of the lamp providing a visual indication that the unit is ready for use. Deactuation of the solenoid 51 permits the spring 57 to draw the leg 59 to the left as illustrated in FIG. 4, thereby causing the tether wheel 43 to move away from the tether wheel 41. Further, the deactivation of the tether wheel motor 53 terminates the rotation of the tether wheel 41. It will thus be seen that, at this time, the tether 25 is no longer being urged into the tube 39. The cessation of force on the tether urging it into the tube 39 permits the force of the spring 77 to draw the rod 73 to the position shown in solid lines in FIG. 4 and it will now be understood why the rod 73 remains in its clockwise rotated position only momentarily. It is appropriate at this point to indicate that the spring 77 serves another function as well. In the event that the ball 21 is struck with substantial force causing the rapid removal of the tether 25 stored within the tube 39, then the block 37, connected to the tether 25, will strike the rod 73 with substantial force. The spring 77 will, in such event, provide a countervailing force preventing the rod 73 from rotating too great a distance in a clockwise direction (as seen in FIG. 4) and will further prevent the tearing away of the tether 25 from the reel 31.

At this time, the device has terminated its sequence of events and is ready, as indicated by the ready lamp beneath aperture 17, to be utilized as a practice apparatus. The golfer may now strike the ball 21 and the ball will be driven from the unit without having to cause the rotation of the reel 31, thus permitting the ball 21 to be driven from the apparatus without having to overcome the inertia of the reel. After the ball comes to rest, subsequent to it being struck by the user, the switch 15 is actuated, thereby extinguishing the "ready" lamp positioned beneath the window 17 and as previously noted, actuating the lamp positioned beneath the window 19, labelled "not ready." The depression of the switch 15 actuates the reel motor 29, as previously noted, and the sequence of events described above, beginning with the drawing of the ball 21 toward the apparatus 1, again commences.

It is noted that the foregoing description did not discuss either the speed with which the reel 31 drew the tether 25 and ball 21 toward the device or the speed with which the wheel motor 53 caused the tether 25 to be withdrawn from the reel 31 and coiled within the tube 39. This is because it is understood that the apparatus will be constructed using components (motors, etc.) having characteristics which will provide the desired speed of operation and such speed will, no doubt, depend in part on the type of practice in which the apparatus is to be utilized. Further, it will be understood that it is within the scope of the present invention to provide for gearing or comparable arrangements whereby the speed with which the ball 21 is retrieved by the device and the speed with which the tether is stored in the tube 39 may be varied, either continuously or incrementally, depending, of course, on the type of practice desired, the type of ball utilized, the length of tether utilized, and the environment in which the practicing occurs.

Although the foregoing description did not disclose a source for the electrical energy required to operate the disclosed device, it will be of course understood that the energy required may be obtained from any one of a number of conventional sources in any conventional manner. Thus, the apparatus may be battery operated, the battery being either of the disposable type or of one of the rechargeable types such as, for example, those of nickel-cadmium construction. Alternatively, the device may utilize conventional alternating current, in which case a transformer may advantageously be incorporated into the device to enable the use of DC motors.

It will be understood that the foregoing description of the preferred embodiment of the present invention is for purposes of illustration only, and that the various structural and operational features as herein disclosed are susceptible to a number of modifications and changes, none of which entail any departure from the spirit and scope of the present invention as defined in the hereto appended claims.

What is claimed is:

1. Retrieval apparatus for a ball comprising:

a tether for connection to said ball;

a base;

a take-up reel for said tether, a selectively actuatable reel motor for said tether and adapted to draw a ball, connected by the tether to said reel, toward said base;

reel motor switching means connected to said reel motor for automatically deactivating said motor in response to the drawing of said ball to a pre-selected position relative to said base;

first and second rotatable tether drive wheels mounted on the base;

shifting means coupled to at least one of the tether drive wheels and responsive to the activation of said reel motor switching means for decreasing the distance between said tether drive wheels whereby said wheels frictionally engage said tether;

a selectively actuatable wheel motor mounted on said base and activated in response to the activation of said reel motor switching means for rotating said tether wheels, whereby said tether wheels remove at least a portion of said tether from said take-up reel;

an elongated tubular member having openings at both ends thereof coupled to said base;

guide means located between said tubular member and said tether drive wheels, at least a portion of said guide means extending through one of said tubular end openings and being located within said tubular member, said tubular member receiving at least a portion of the tether removed from said take-up reel and maintaining said tether in a slack condition; and wheel motor switching means coupled to said wheel motor for deactivating the wheel motor in response to the removal of a pre-selected length of tether from the take-up reel.

2. Retrieval apparatus for an object comprising:

support means;

recovery means attached to said support means, an elongated tether connected to said recovery means and having a free end for connection to said object;

means for operating said recovery means to draw said tether means toward said support means; and slacking means for providing slack in said tether and including means for removing at least a portion of the tether from said recovery means and means for receiving said removed portion.

3. Retrieval apparatus according to claim 2 wherein said removing means includes a rotatable wheel adapted to frictionally engage said tether.

4. Retrieval apparatus according to claim 2 wherein said receiving means comprises an elongated member having an opening in at least one end thereof.

5. Retrieval apparatus according to claim 4 wherein said receiving means further comprises guide means located between said elongated member and said removing means.

6. Retrieval apparatus according to claim 5 wherein at least a portion of said guide means extends through said opening and is located within said elongated member.

7. Retrieval apparatus according to claim 4 wherein said elongated member has a tubular configuration.

8. Retrieval apparatus according to claim 3 further comprising means for selectively moving said rotatable wheel into and out of frictional engagement with said tether.

9. Retrieval apparatus according to claim 2 wherein said recovery means comprises a take-up reel and further comprising a selectively actuatable reel motor for driving said take-up reel, said motor including reel motor switching means for automatically deactivating said motor in response to the drawing of said tether to a pre-selected position relative to said support means.

10. Retrieval apparatus according to claim 9 wherein said slacking means further comprises:

first and second rotatable tether drive wheels;

shifting means responsive to the activation of said reel motor switching means for decreasing the distance between said tether drive wheels whereby said wheels frictionally engage said tether; and a selectively actuatable wheel motor activated in response to the activation of said reel motor switching means for rotating said tether wheels, whereby said tether wheels remove at least a portion of said tether from said take-up reel.

11. Retrieval apparatus according to claim 9 further comprising wheel motor switching means coupled to said wheel motor for deactivating the wheel motor in response to the removal of a pre-selected length of tether from said take-up reel.

12. Retrieval apparatus as in claim 2 wherein said slacking means comprises:

an elongated hollow receptacle having an opening in at least one end thereof forming said receiving means; and drive means for moving said flexible line into said receptacle in a series of free loops located adjacent one another.

13. Retrieval apparatus as in claim 12 further comprising guide means, said drive means moving said flexible line through said guide means to said receptacle.

14. Retrieval apparatus according to claim 13 wherein one end of said guide means extends through the opening of said receptacle and into the interior thereof.

15. Retrieval apparatus according to claim 13 wherein the one end of said guide means into which the drive means moves the flexible line has a V-shaped cross-section.

16. Retrieval apparatus according to claim 12 wherein said receptacle has a tubular cross-section.

17. Retrieval apparatus according to claim 12 wherein said drive means comprises at least one toothed drive wheel adapted to frictionally engage said flexible line, whereby said line is moved in response to the rotation of said wheel.

18. A tether type apparatus comprising:

a flexible line tether adapted to have a weighted object connected to one end thereof;

receptacle means having an opening in one end thereof for storing a quantity of the flexible line tether therein in a series of free loops located adjacent one another whereby when the object is moved the loops unwind and the tether elongates; and means for recovering the elongated portion of the tether.

19. Apparatus as in claim 18 further comprising:

drive means for moving a portion of said tether into said receptacle in the series of loops.

20. Apparatus as in claim 19 wherein said drive means operates by removing a portion of the tether from said recovery means.

21. Apparatus as in claim 20 wherein said recovery means comprises driven reel means.

22. Apparatus as in claim 18 wherein said receptacle comprises an elongated tube.

* * * * *